United States Patent [19]

Morizzo

[11] Patent Number: 4,930,711

[45] Date of Patent: Jun. 5, 1990

[54] AUTOMATIC DEFECT CUTTING ASSEMBLY FOR A CONTINUOUS FABRIC WINDER

[75] Inventor: Nicholas L. Morizzo, Newport Richey, Fla.

[73] Assignee: Krantz America, Inc., Charlotte, N.C.

[21] Appl. No.: 297,425

[22] Filed: Jan. 17, 1989

[51] Int. Cl.[5] ..... B65H 19/26

[52] U.S. Cl. ..... 242/56 R; 242/59

[58] Field of Search ..... 242/56 R, 56.1–56.9, 242/57.1, 59; 26/70; 83/371

[56] References Cited

U.S. PATENT DOCUMENTS

| | | | |
|---|---|---|---|
| 2,539,745 | 1/1951 | Keller | 242/56 R X |
| 2,834,558 | 5/1958 | Halpin | 26/70 |
| 3,721,396 | 3/1973 | Morizzo | 242/56 R |
| 3,782,664 | 1/1974 | Alberto | 242/56 R |
| 3,869,095 | 3/1975 | Diltz | 242/56 R |
| 3,892,153 | 7/1975 | Kato | 83/100 |
| 4,082,589 | 4/1978 | Patterson et al. | 242/59 X |
| 4,351,494 | 9/1982 | Schippers et al. | 242/35.5 A |
| 4,384,686 | 5/1983 | Wiley et al. | 242/57.1 |
| 4,489,900 | 12/1984 | Morizzo | 242/56 R |
| 4,508,279 | 4/1985 | Tokuno et al. | 242/56 R |
| 4,629,531 | 12/1986 | Kataoka | 242/56 R X |
| 4,770,359 | 9/1988 | Kluchi | 242/56 R |

FOREIGN PATENT DOCUMENTS

| | | | |
|---|---|---|---|
| 2096580 | 10/1982 | United Kingdom | 242/56 R |

*Primary Examiner*—Donald Watkins

*Attorney, Agent, or Firm*—Shefte, Pinckney & Sawyer

[57] ABSTRACT

A method and apparatus for removing a section of a sheet of material being wound on a roll. The apparatus removes the section and then positions the lengths preceding and following the removed section in overlapping relationship with one another so that the overlapped lengths can be wound onto the roll. In the preferred embodiment, the preceding length of the sheet is temporarily displaced from the travel path by a vacuum plate and, during the temporary displacement, the section to be removed is moved downstream to a discharge position and the following length is moved into overlapping relationship with the displaced preceding length. Additional winding assemblies for winding the sheet onto other rolls can be used to provide a substantially continuous winding operation.

19 Claims, 1 Drawing Sheet

AUTOMATIC DEFECT CUTTING ASSEMBLY FOR A CONTINUOUS FABRIC WINDER

BACKGROUND OF THE INVENTION

In the textile industry, the processing of sheets of material typically includes the step of inspecting the sheet to identify defective material. Later, the sheet is wound onto a sleeve to form a full package or roll of finished material.

Prior to winding the sheet into a finished package, sheet sections having major defects often are severed from the sheet and discarded. If the cutting and removal of the defective section occurs as the sheet is being wound into a finished package, the winding operation must be halted while the defective section is cut and removed. Moreover, an overlapping between the sheet length following the removed defective section and the sheet length preceding the defective section is often desired and this overlapping must necessarily be arranged before the preceding section has been fully wound onto the roll.

The cutting and removal of the defective sections and the overlapping of the preceding and subsequent sections significantly increases the time required to wind a sheet into a finished roll. Accordingly, the need exists for a method and apparatus which minimizes the dead time of the winding operation by increasing the speed of the cutting and removal of the defective sections and overlapping operations. Additionally, the need exists for a method and apparatus which is adaptable to both defective sections and cutting and removal operations which lag the inspection of the sheet (i.e., cutting and removal operations controlled by a computer inputted with a defective section record disk). Furthermore, there is a need for a method and apparatus for cutting and removing samples from a sheet with minimum disruption of the winding process.

SUMMARY OF THE INVENTION

Briefly described, the present invention provides, in a method of winding a traveling sheet of continuous length material onto a supporting roll, a method for removing a section of the sheet and thereafter continuing to wind the following length of the sheet on the roll. According to this method, the sheet, including a length preceding the section to be removed, is fed along a predetermined path to the winding roll. When a leading portion of the section to be removed advances to a predetermined cutting location along the path, the sheet is cut tranversely at the leading portion of the section to be removed to sever the preceding length of the sheet of material from the section to be removed. The section to be removed and the following length of the sheet of material is then advanced along the path and, when a trailing portion of the section to be removed is advanced to the cutting location, the trailing portion of the section to be removed is transversely cut to sever the section to be removed from the following length of the sheet of material. The severed section to be removed is advanced along the path to a discharge position, and the following length of the sheet of material is advanced along the path into overlapping relation with preceding length of the sheet of material, whereupon the feeding of the preceding and following lengths of the sheet of material along the path to the roll is resumed.

Preferably, the method further includes the step of temporarily displacing a portion of the preceding length of the sheet from the path and positioning the following length of the sheet in overlapping relation with the preceding length during the temporary displacement of the preceding length from the path.

The present invention also provides, in an apparatus for winding a traveling sheet of continuous length material onto a supporting roll, an apparatus for removing a section of the sheet and thereafter continuing to wind the following length of the sheet on the roll. Basically the apparatus comprises means for feeding the sheet, including a length preceding the section to be removed, the section to be removed and a length following the section to be removed, along a predetermined path to the winding roll and means for tranversely cutting the sheet at the leading portion of the section to be removed to sever the preceding length of the sheet of material from the section to be removed when a leading portion of the section to be removed advances to a predetermined cutting location along the path and for transversely cutting the trailing portion of the section to be removed to sever the section to be removed from the following length of the sheet of material when a trailing portion of the section to be removed is advanced to the cutting location. The feeding means includes means for advancing the severed section to be removed to a discharge position and for advancing the following length of the sheet of material along the path into overlapping relation with the preceding length of the sheet of material. Means are also provided for controlling actuation and deactuation of the feeding and cutting means.

DETAILED DESCRIPTION OF PREFERRED EMBODIMENTS

Figure 1:
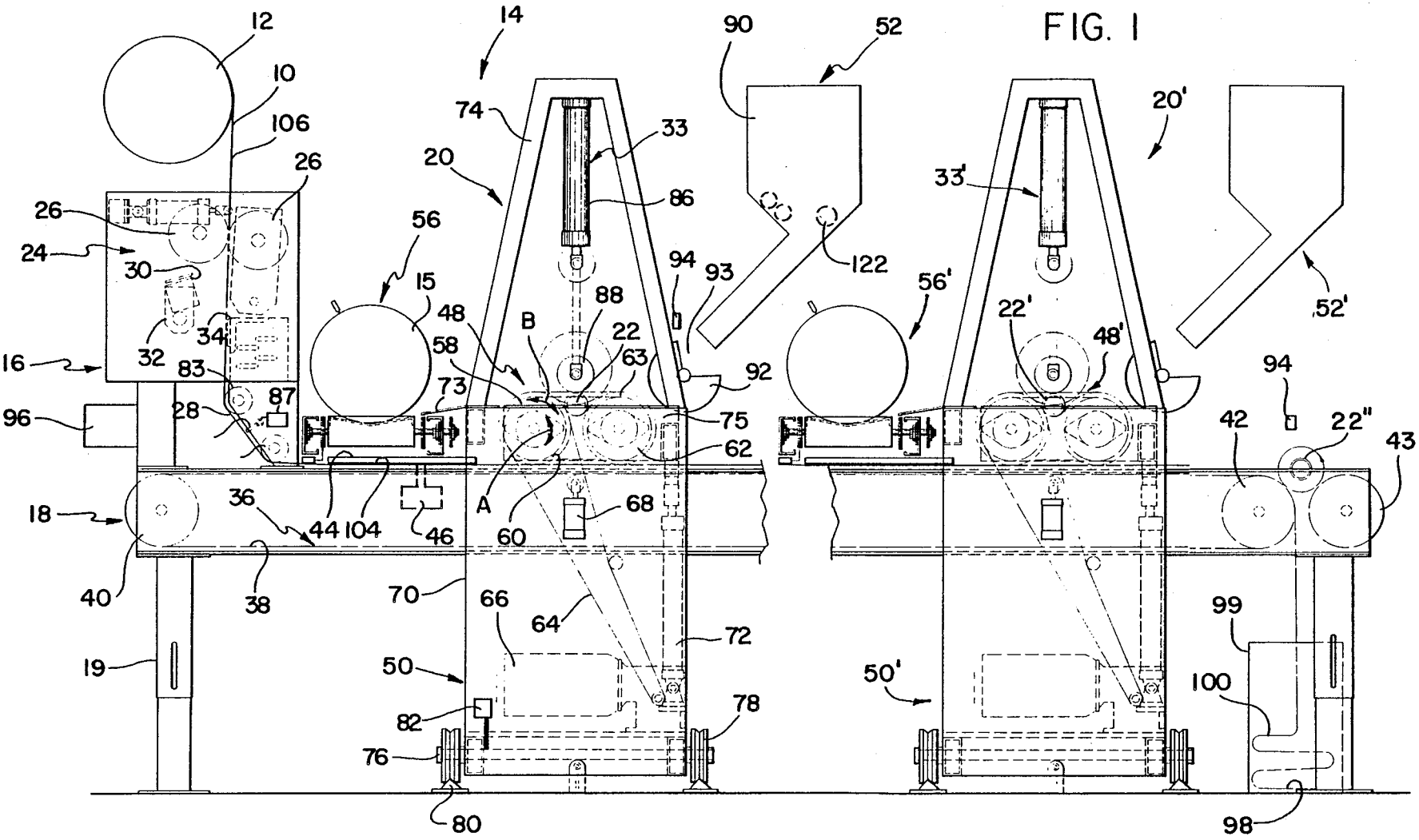
FIG. 1 is a front elevational view of a textile machine for continuously winding fabric into a package, showing one preferred embodiment of the automatic defect cutting assembly of the present invention.

In accordance with the present invention, a method and apparatus are provided for winding a fabic sheet 10 into a finished roll of frabic, e.g., roll 15, with the capability for severing and removing selected sections from the sheet 10, the overall winding apparatus of the present invention being broadly designated as 14. As seen in the drawing, the sheet of fabic 10 previously inspected at an inspection station and wound on an intermediate roll 12 is ready to be further handled by the winding apparatus 14 for rewinding onto a supporting sleeve or roll 22 and, as necessary or desirable, for removal from the fabic sheet 10 of selected sections such as, for example, defective sections or alternatively sample sections. Basically, the winding apparatus 14 includes an intake and cutting assembly 16 for unwinding the sheet 10 from the intermediate roll 12 and transversely cutting selected portions of the sheet, a conveyor assembly 18 for conveying the sheet from the intake and cutting assembly 16 and a winding assembly 20 for receiving the conveyed sheet and winding it onto the supporting roll 22.

The intake and cutting assembly 16 includes a feed assembly 24 having a pair of cooperating driven feed rollers 26 for directing the sheet 10 inserted therebetween to travel along a feed path 28 terminating at the supporting roll 22. The intake and cutting assembly 16 further includes a blade 30 mounted to the free end of a rotatable arm 32 for rotation about a circular path at one side of the travel path of the sheet 10 and an anvil 34 positioned at the other side of the travel path of the sheet 10 relative to the circular path of the blade 30 such that the blade 30 and the anvil 34 cooperate to transversely cut the sheet 10 passing therebetween.

The conveyor assembly 18 includes an upstanding frame 19 which supports a conventional endless belt-type conveyor 36 for further conveying the sheet 10 exiting the intake and cutting assembly 16 along the feed path 28 to the winding assembly 20. The conveyor 36 includes a belt 38 trained around a guide roller 40 and a drive roller 42 rotatably mounted on the frame 19, the upper run of the belt 38 extending horizontally in a direction generally perpendicular to the initial downward direction of the feed path 28 through the intake and cutting assembly 16.

The conveyor assembly 18 also includes a vacuum plate 44 coupled to a vacuum source, shown only schematically at 46. Vacuum plate 44 is rectangularly shaped and is provided on its bottom surface with a number of apertures or slots through which air can be drawn during operation of the vacuum source 46. The vacuum plate 44 is secured to the frame 19 of the conveyor assembly 18 with the bottom surface of the vacuum plate 44 positioned slightly above and in parallel facing relation to the upper run of the conveyor belt 38 which defines the feed path 28. As can thus be understood, upon selective actuation of the vacuum source 46, the vacuum plate 44 is operative to draw the sheet 10 against the bottom surface of the plate 44 under the suction force of the vacuum source 46 as the sheet passes underneath the plate along the feed path 28.

The winding assembly 20 includes a structural frame 70 supporting a winding roller assembly 48 for supporting the sleeve or roll 22 for winding of the sheet 10 thereon and a transverse positioning assembly 50 for adjusting the roller assembly 48 transversely in proper relationship with respect to the transverse position of the sheet 10 on the belt 38. Additionally, the winding assembly 20 includes a roll dispensing assembly 52 for individually dispensing empty rolls 122 to the roller assembly 48 to serve as supporting rolls 22 and a winding control assembly 33 for maintaining the active roll 22 in proper winding relationship to the roller assembly 48 during the winding process, each of the roll dispensing and winding control assemblies 52, 33 being mounted to the frame 70. A transport assembly 56, preferably in the form of another endless belt conveyor, extends alongside the roller assembly 48 intermediate the intake and cutting assembly 16 and the winding assembly 20 for transporting fully wound fabric rolls, e.g. roll 15, to locations for further handling. As desired, the transport assembly 56 may be provided with an associated load cell or other suitable means for weighing each ejected full roll 15.

With further regard to the roller assembly 48, the assembly includes a subframe 75 pivotably or otherwise movably mounted to the main structural frame 70 adjacent the transport assembly 56, the subframe 75 rotatably supporting a pair of cooperative winding rollers 58, 62 in spaced axially parallel relation substantially transversely with respect to the fabric travel path 28 for peripherally supporting the roll 22 in parallel relation between the rollers 58, 62. The circumferential periphery of the winding roller 58 is provided with a plurality of perforations uniformly distributed thereover and a stationary baffle arrangement (not shown) is disposed interiorly within the winding roller 58 in covering relation to the perforations 60 over most of the peripheral extent of the roller 58 except for a first predetermined arcuate extent A thereof extending from a point adjacent and generally tangential to the feed path 28 to a point adjacent the location of surface contact between the winding roller 58 and the supporting roll 22 and a second predetermined arcuate extent B extending from the point of surface contact between the winding roller 58 and the supporting roll 22 a short arcuate extent, e.g. approximately 60–75 degrees, in the direction of rotation of the winding roller 58, the baffle arrangement also forming a radial dividing wall between the arcs A and B. A suitable vacuum source (not shown) is communicated through the axis of the winding roller 58 with its interior segment corresponding with the arc A. Likewise, a suitable blower or other source of a positive forced air flow (also not shown) is communicated through the axis of the winding roller 58 with its interior segment corresponding to the arc B. Thus, the vacuum source draws air radially into the winding roller 58 through its periphery 60 as it moves through the predetermined arc A of the rotation of the roller 58, while the blower forces air radially outwardly from the winding roller 58 through its perforated periphery 60 as it moves through the arc B of the rotation of the roller 58. As the sheet 10 is progressively fed along feed path 28 and passes underneath winding roller 58, the vacuum effect created through perforations 60 is sufficiently powerful to raise the sheet 10 from the feed path and draw it against the perforations 60 of the winding roller 58. As the winding roller 58 rotates with the sheet 10 drawn against it, the sheet is brought to the supporting roll 22 whereat the suction force is blocked by the baffle arrangement and, as the winding roller 58 continues rotation through the arc B, the sheet 10 is subjected to the opposite radially outward forced air flow from the blower to cause the sheet 10 to separate from the winding roller 58 for winding onto the supporting roll 22 into a finished package. The winding roller 62 is connected by a chain or belt 63, or other suitable means, for synchronous counter-clockwise rotation with the winding roller 58, thereby cooperating with the winding roller 58 to impart a rotating movement to the supporting roll 22 to wind the sheet 10 thereon. A drive chain or belt 64 of a drive motor 66 provides rotational power to the winding rollers 58, 62. Preferably, the drive chain 63 is also trained about a clutch (not shown) to allow the winding roller 62 to be driven at differential speeds with respect to the winding roller 58 to achieve a desired fabric tensioning and compaction on the supporting roll 22.

The conveyor assembly 18 additionally includes a selectively actuable feed piston 68 positioned below the upper run of the conveyor belt 38 and generally vertically aligned with the roll winding area between the winding rollers 58, 62. Feed piston 68 has a roller at its free end for contacting the underside of the conveyor belt 38 to raise the belt 38 and the sheet 10 thereon upwardly against the cylindrical outer surface of winding roller 58 to insure proper receipt of the sheet 10 against the periphery of the winding roller 58.

The transverse positioning assembly 50 of the winding assembly 20 includes a pair of spaced apart axles 76 (only one of which is shown) each of which rotatably supports a pair of wheels 78 by which the frame 70 is supported for movement of a pair of floor-mounted rails 80 positioned transversely with respect to the sheet's travel path 28. Wheels 78 have radially inward a annular grooves which cooperate to receive the rails 80. A motor, shown only schematically at 82, is provided for selectively driving the wheels 78 for moving the winding assembly 20 along the rails 80. As can thus be understood, the frame 70 can be rolled back and forth along rails 80 to thereby change the transverse orientation of the roller assembly 48 with respect to the sheet 10.

The winding assembly 20 further includes a pneumatic or hydraulic cylinder 72 coupled to frame 70 and having an associated piston coupled to the subframe 75 of the roller assembly 48 to be operable to tilt the subframe 75 when necessary or desirable so that a finished fully wound fabric package 15 formed on a supporting roll 22 may be ejected from the winding area between the rollers 58, 62 to roll over the roller 58 and along a discharge plate 73 whereupon the package 15 falls onto the transport assembly 56.

The transverse positioning assembly 50 is connected to a photosensor 84 mounted upstream of the roller assembly 48 within the intake and cutting assembly 16 alongside the initial extent of the feed path 28. Feed path 28 follows a generally vertically downward direction through the intake and cutting assembly 16 from intermediate roll 12, through feed rollers 26 and past the blade 30, and therefrom generally diagonally about a pair of directional guide rollers 83, 85 between which the photosensor 84 is positioned. Thereafter, feed path 28 extends generally horizontally along the upper belt run of the conveyor assembly 18 to the underside of winding roller 58. The directional rollers 83, 85 provide support for sheet 10 as it changes direction from the generally vertical extent of feed path 28 along the diagonal portion of the feed path adjacent the photosensor 84 to its horizontal extent along the conveyor assembly 18. The photosensor 84 is supported by a motor, shown only schematically at 87, for movement transversely with respect to the feed path 28 in the region between the guide rollers 83, 85, the motor being operable to always move the photosensor 84 at the start of a winding operation to a disposition whereat the photosensor 84 detects one lengthwise edge of the sheet 10, thereby to determine the widthwise disposition of the sheet 10 with respect to the conveyor. The photosensor motor 87 and the motor 82 are connected to operate synchronously so that movement of the photosensor 84 is accompanied simultaneously by corresponding movement of frame 70 along rails 80 to thereby bring roller assembly 48 into proper alignment for receipt and winding of sheet 10. Additionally, the roller 85 includes a load cell operatively connected to the motor 66 to control the peripheral speed of the winding rollers 60, 62 for maintaining a uniform tensioning of the sheet 10.

The nip control assembly 33 includes a pair of piston and cylinder assemblies 86 mounted at a transverse spacing to one another on an upstanding extension 74 of the frame 70 immediately above and projecting downwardly toward the winding area between the vacuum and winding rollers 58, 62. The piston and cylinder assemblies 86 rotatably support opposite ends of a roll 88 and are operative to urge the roll 88 into peripheral biasing contact with the supporting roll 22 and the sheet material wound thereon for rotatably urging and maintaining the supporting roll 22 in peripheral winding contact with the rollers 58, 62 in the winding area defined therebetween. The piston and cylinder assemblies 86 are operated to gradually upwardly retract their pistons into their respective cylinders in response to the increasing diameter of the sheet material being wound on the supporting roll 22. As desirable, the force exerted by the piston and cylinder assemblies 86 may be varied over the course of a winding operation for controlling the tensioning of the sheet 10 wound on the roll 22.

The roll dispensing assembly 52 includes a hopper 90 which contains a quantity of empty rolls 122 and which dispenses the rolls 122 individually to a segmented peripheral compartment 93 in a cylindrical dispenser 92. The dispenser 92 is selectively reciprocable about a rotational axis to feed an empty roll 122 to the winding area between the rollers 58, 62 to serve as a supporting roll 22 for the winding of the sheet 10 thereon. A spray nozzle 94 may be mounted adjacent the cylindrical dispenser 92 to apply an axial line of adhesive across each dispensed roll 122, whereby the leading edge of a sheet 10 fed to the winding area between the rollers 58, 62 adheres to the adhesive on the roll 122 to commence rolling of the sheet onto the roll 122. However, in many, if not most, circumstances, the forced air flow emitted through the arc B of the periphery of the winding roller 58 will be sufficient to separate the sheet 10 from the roller 58 to apply the leading edge of the sheet onto the roll 122 at the start of a winding operation so that the spray nozzle 94 may not be necessary.

The winding apparatus 14 also includes a suitable controller, such as a conventional commercially available programmable microprocessor or microcomputer, as representatively shown only schematically at 96, which is operatively connected to roller assembly 48, feed rollers 26, rotating arm 32, conveyor 36 and vacuum plate 44, to coordinate the operations of the intake and cutting assembly 16, the conveyor assembly 18 and the winding assembly 20. The operation of controller 96 is described in the following discussion of the operation of the winding apparatus 14 to selectively cut and remove certain sections of sheet 10 and to overlap lengths of sheet 10 following and preceding the removed sections.

The operation of the winding apparatus 14 is as follows. During the winding of sheet 10 into the intermediate roll 12 at an inspection station, an inspector identifies defective sections of the sheet 10 to be removed and records the location of these defective sections on an appropriate medium, such as a disk, for inputting into the controller 96. Accordingly, when sheet 10 is fed from intermediate roll 12 for winding onto a supporting roll 22 to form a finished fabric package, the controller 96 controls the sequence of operation of the various assemblies of the winding apparatus 14 in response to the defect location information recorded on the disk generated at the inspection station.

Initially, the leading edge of the sheet 10 is manually inserted between feed rollers 26 and thereafter advanced by the feed rollers 26 and the conveyor assembly 18 along feed path 28 to roller assembly 48. As sheet 10 is fed along feed path 28, photosensor 84 senses the relative widthwise disposition of the sheet 10 with respect to the conveyor belt 38 and controls the operation of the motor 82 to position the frame 70 of the winding assembly 20 to properly align its roller assembly 48 for receipt of the sheet 10. The controller 96 also controls operation of the drive motor 66 to thereby control rotation of the winding roller 58 and the winding roller 62, actuation of the suction applied to the winding roller 58, and actuation of the feed piston 68. The winding roller 58 and the feed piston 68 cooperate together in the manner described above to lift the leading edge of sheet 10 upward from feed path 28 to the supporting roll 22. Once the leading edge of the sheet 10 is adhered to the supporting roll 22, feed piston 68 is retracted to a resting position withdrawn from contact with the conveyor belt 38.

The winding operation then proceeds with the feed assembly 24 and the conveyor assembly 18 continuously delivering the sheet 10 to the winding roller 58 and the winding roller 62 which rotate the supporting roll 22 in a clockwise direction to build windings of the sheet 10 thereon. The roller 88 of the piston and cylinder assemblies 86 holds the periphery of the supporting roll 22 and the sheet wound thereon in frictional contact with the winding roller 58 and the roller 62. The roller 88 is progressively retracted, under the control of controller 96, in response to the increasing diameter of the sheet material on the roll 22.

As the winding of the sheet 10 on the supporting roll 22 proceeds, the sheet 10 is continuously unrolled from the intermediate roll 12 and travels past the anvil 34. In response to the defect location information on the disk, controller 96 actuates rotation of the blade 30 to sever the sheet 10 transversely when a leading portion of a section to be removed, e.g. a defective section of the sheet 10, is drawn into alignment with the anvil 34. As necessary or desirable, the feed rollers 26, the conveyor assembly 18 and the rollers 58, 62 may be stopped during the severing operation.

Following the severing operation, the conveyor assembly 18 and the rollers 58, 62 briefly continue to advance the lengthwise extent of the sheet 10 preceding the section to be removed for winding onto the supporting roll 22, until the just severed trailing edge of the lengthwise extent of the sheet 10 preceding the section to be removed is advanced to a disposition below vacuum plate 44 whereupon controller 96 activates the vacuum source 46 to apply a suction force through the vacuum plate 44 to thereby draw the trailing edge portion of the preceding sheet extent against the bottom surface of vacuum plate 44. As necessary or desirable, the feed rollers 26 may be stopped during this operation so that the lengthwise extent of the defective section of the sheet 10 trailing its just severed leading portion is not further unrolled from intermediate roll 12. The suction operation of the vacuum plate 44 serves to raise the unwound portion of the lengthwise extent of the sheet preceding the section to be removed sufficiently above the conveyor belt 38 that the defective section can be transported by conveyor 36 underneath the unwound portion of the preceding length held by the vacuum plate 44.

While the trailing edge portion of the preceding length of the sheet 10 is drawn by suction against the vacuum plate 44, the feed rollers 26 advance the lengthwise extent of the sheet 10 trailing the sever just formed, with the section to be removed at its leading end, until a trailing portion of the section to be removed is aligned with the anvil 34 whereupon the rotating blade 30 is again activated by the controller 96 to sever the sheet 10 transversely thereat to separate the section to be removed from the following lengthwise extent of the sheet 10 extending from the roll 12. The conveyor 36 then transports the severed section of the sheet 10 along feed path 28 to pass beneath the trailing portion of the preceding sheet extent held by the vacuum plate 44 and beneath the roller assembly 48, the feed piston 68 remaining deactivated at its resting position, to transport the severed sheet section to a discharge position at the end of the upper run of the conveyor belt 38. Such severed sheet sections may be discharged to simply fall from the conveyor belt 38 into a collection bin 99 positioned beneath the end of the conveyor 36, as indicated in the drawing by a severed section 100 of the sheet 10 which has been cut at a leading severed edge portion 98. Alternatively, an auxiliary roller 43 is positioned immediately adjacent and parallel to the driven roller 42 of the conveyor 36 to cooperate therewith for supporting a winding roll 22" so that severed sheet sections may instead be wound onto the roll 22". To facilitate such winding, an adhesive spray nozzle 94 may be positioned adjacent the roll 22".

Simultaneously with, or subsequent to, the conveying of the severed section 100 to the discharge position, the following length of sheet 10 can be be advanced along feed path 28 by operation of feed rollers 26 and the conveyor 36. As the following length of the sheet 10 is transported by the conveyor 36, the leading edge portion of the following length of the sheet 10 passes beneath the trailing edge portion of the preceding length of the sheet 10 still held by the vacuum plate 44 so that the two portions are in overlapping relationship to one another. When the following length of the sheet 10 has advanced sufficiently to achieve the desired lapping with the preceding length, the controller 96 deactivates the vacuum source 46 so that the trailing edge portion of the preceding sheet length falls in overlapping relation onto the following sheet length on the conveyor 36 therebelow, whereby the overlapped portions of the sheet 10 are transported in such relationship to the roller assembly 48.

When the overlapping portions of the lengthwise extents of the sheet 10 which preceded and followed the severed section reach the winding roller 58, the controller 96 activates the feed piston 68 to cooperate with the winding roller 58 to insure that the following length of the sheet 10 is suctioned and thereby transported by the winding roller 58 into the winding area and wound onto the supporting roll 22. As will be understood, the fabric construction of the sheet 10 is sufficiently permeable that the suction through the winding roller 58 acts on each of the lapped portions of the sheet 10. The winding of the sheet 10 on the supporting roll 22 then continues in coordination with the feed of the following length of the sheet 10 by feed rollers 26 and the conveyor 36 until (1) the sheet 10 has been wound on the supporting roll 22 to its full capacity, (2) sheet 10 has been completely unrolled from intermediate roll 12, or (3) the leading portion of another section to be removed moves into alignment with anvil 34. If another section is to be removed, the cutting and subsequent removal of that section to the discharge position, the raising of the section preceding that section and the overlapping of the preceding and subsequent sections proceeds in similar fashion to the operation described above.

Once the sheet 10 has been fully wound on the supporting roll 22, the controller 96 activates the cylinder 72 to lift the support assembly subframe 75 and thereby eject the fully wound roll onto the transport assembly 56. As the subframe 75 is returned to its operating position, the compartmented cylindrical dispenser 92 is reciprocated to deliver an empty sleeve 122 to the winding area of the roller assembly 48 between the rollers 58, 62 whereupon the winding apparatus 14 is ready to continue the winding of the sheet 10 or another sheet into another fully wound roll.

The present invention thus provides a method and apparatus for rapidly removing sections of a sheet so that the winding of the sheet into a finished package can be quickly resumed. Additionally, the present invention provides a method and apparatus which allows a desired overlap to be achieved between the respective portions of the sheet preceding and trailing the removed section with minimum disruption to the winding process. Additionally, the present invention provides a method and apparatus for precisely severing selected sections of a sheet with only a minimum disruption to the winding process.

Although the operation of the winding apparatus 14 has been described with respect to a sheet with the locations of the sections to be removed previously recorded on a disk at an inspection station, the method and apparatus of the present invention can be used in similar fashion with a sheet being inspected contemporaneously with the winding operation and passing directly to the present winding apparatus 14 without being wound into an intermediate roll 12. In such circumstances, for example, an inspector could supply signals directly to controller 96 corresponding to the location of the removal sections.

It is further contemplated that one or more additional winding and transport assemblies 20, 56 can be operated in coordination with one another to further speed the winding process. For example, a second winding assembly, generally designated as 20', and a second companion transport assembly 56', are shown in a position downstream of the conveyor 36 from the winding assembly 20. The second winding assembly 20' is essentially identically configured to the winding assembly 20 and basically includes a roller assembly 48' which is operable to wind the sheet 10 onto a supporting roll 22' to form a finished package as well as a transverse positioning assembly 50' which is also controlled by the photosensor 84, a roll dispensing assembly 52', and a winding control assembly 33'.

The operation of the second winding assembly 20' in conjuction with the winding assembly 20 is as follows. Photosensor 84, through its motor 87, controls the alignment of both the winding assemblies 20 and 20' to orient their respective roller assemblies 48, 48' in proper relationship transversely with respect to the feed path 28. The winding assembly 20 is operated in the manner described above to wind the sheet 10 onto the supporting roll 22. When the supporting roll 22 of the winding assembly 20 has been wound to its full capacity and there is still a length of the sheet 10 remaining on the intermediate roll 12, the cutter blade 30 is actuated to sever the sheet 10 after which the extent of the sheet 10 preceding the cut is wound onto the roll 22 and the process of ejecting the fully wound roll 22 and dispensing a new empty roll 122 is initiated. In the meantime, the leading edge of the remaining length of the sheet 10 is advanced downstream beyond the winding assembly 20 to the winding assembly 20' whereupon continued winding of the sheet 10 onto the supporting roll 22' thereof is immediately initiated without the need to await completion of the ejection of the finished roll 22 and readying of a new roll 122 at the winding assembly 20. Thus, while the winding assembly 20 is in the process of depositing the full roll 22 onto the transport assembly 56 and receiving an empty roll 122 from cylindrical dispenser 92, the winding assembly 20' can begin winding the 10 on supporting roll 22' without delay. As can be understood, additional winding assemblies can be added in similar manner so that the winding process can be accomplished in nearly continuous fashion with a sheet being wound on a sleeve substantially during the entire time.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. In a method of winding a traveling sheet of continuous-length material onto a supporting roll, a method for severing and removing a section of the sheet and thereafter continuing to wind the following length of the sheet on the roll, comprising:

feeding the sheet, including a length preceding the section to be removed, along a predetermined path of the roll;

when a leading portion of the section to be removed advances to a predetermined cutting location along the path and while continuing the feeding movement thereof along the path, transversely cutting the sheet at the leading portion of the section to be removed to sever the preceding length of the sheet of material from the section to be removed;

thereafter temporarily ceasing the feeding of the preceding length of the sheet along the path and suctioning a portion of the preceding length of the sheet to temporarily displace the preceding length portion from the path;

advancing the section to be removed and the following length of the sheet of material along the path;

when a trailing portion of the section to be removed is advanced to the cutting location and while continuing the feeding movement thereof along the path, transversely cutting the trailing portion of the section to be removed to sever the section to be removed from the following length of the sheet of material;

advancing the severed section to be removed along the path to a discharge position;

advancing the following length of the sheet of material along the path to the location of suctioning of the preceding length of the sheet of material;

thereupon discontinuing the suctioning of the preceding length portion to return the preceding length portion to the path in overlapping relation to the following length of the sheet of material; and resuming the feeding of the preceding and following lengths of the sheet of material along the path to the roll.

2. In a method of winding a traveling sheet, a method according to claim 1 and characterized further by sensing the transverse position of the sheet with respect to the roll and positioning the roll in response to the sensed transverse position of the sheet.

3. In a method of winding a traveling sheet, a method according to claim 1 and characterized further by controlling the transverse cutting of the trailing and leading portions of the section to be removed by means of a control unit.

4. In a method of winding a traveling sheet, a method according to claim 1 and characterized further in that feeding the sheet along the path to the roll includes peripherally driving rotation of the supporting roll by driving a winding roller in peripheral surface contact therewith and applying a biasing force to the supporting roll for maintaining it in surface contact with the winding roller.

5. In a method of winding a traveling sheet, a method according to claim 4 and characterized further in that applying the biasing force includes selectively extending a piston from a cylinder to engage a freely rotatable roller on the free end of the piston with the periphery of the supporting roll and continuing the extension of the piston to press the sheet against the roller of the drive assembly.

6. In a method of winding a traveling sheet, a method according to claim 1 and characterized further by transferring the supporting roll, with a length of the sheet wound thereon, to a location for further handling upon completion of a winding operation.

7. In a method of winding a traveling sheet, a method according to claim 5 and characterized further by weighing the transferred supporting roll.

8. In a method of winding a traveling sheet, a method according to claim 1 and characterized further by advancing the trailing cut portion of the preceding length to a predetermined location before suctioning the preceding length portion of the sheet from the path.

9. In an apparatus for winding a traveling sheet of continuous-length material onto a supporting roll, an apparatus for severing and removing a section of the sheet and thereafter continuing to wind the following length of the sheet on the roll, comprising:

means for feeding the sheet, including a length preceding the section to be removed, the section to be removed and a length following the section to be removed, along a predetermined path to the roll;

means disposed at a predetermined cutting location along the path and operative without stopping said feeding means for transversely cutting the sheet at the leading portion of the section to be removed to sever the preceding length of the sheet of material from the section to be removed when a leading portion of the section to be removed advances to the cutting location and for transversely cutting the trailing portion of the section to be removed to sever the section to be removed from the following length of the sheet of material when a trailing portion of the section to be removed is advanced to the cutting location;

vacuum suction means adjacent the path for drawing and temporarily displacing a portion of the preceding length of the sheet from the path after cutting thereof from the section to be removed and for subsequently releasing the displaced preceding length portion into overlapping relation with the following length of the sheet;

said feeding means including means for advancing the section to be removed to a discharge position and for advancing the following length of the sheet of material along the path to the location of suctioning of the preceding length of the sheet of material; and means for controlling actuation and deactuation of said feeding means, said vacuum suction means and said cutting means.

10. In an apparatus for winding a traveling sheet, an apparatus for removing a section of the sheet according to claim 9 and characterized further in that the means for transversely cutting includes an anvil and a blade relatively movable with respect to one another, the anvil and the blade each being positioned on a respective side of the path.

11. In an apparatus for winding a traveling sheet, an apparatus for removing a section of the sheet according to claim 9 and characterized further in that the means for feeding includes a conveyor.

12. In an apparatus for winding a traveling sheet, an apparatus for removing a section of the sheet according to claim 11 and characterized further in that the vacuum means and the conveyor are positioned at opposite sides of the path such that the sheet of material travels therebetween.

13. In an apparatus for winding a traveling sheet, an apparatus for removing a section of the sheet according to claim 9 and characterized further in that the feeding means includes a pair of cooperating, oppositely rotating rollers positioned at opposite sides of the path for transporting the sheet of material therebetween.

14. In an apparatus for winding a traveling sheet, an apparatus for removing a section of the sheet according to claim 9 and characterized further in that the feeding means includes a rotatable winding roller for peripheral surface contact with the supporting roll for driving rotation of the supporting roll and applying the sheet thereto.

15. In an apparatus for winding a traveling sheet, an apparatus for removing a section of the sheet according to claim 14 and characterized further by means selectively movable toward and away from the winding roller from opposite the path for selectively engaging the sheet of material with the periphery of the roller.

16. In an apparatus for winding a traveling sheet, an apparatus for removing a section of the sheet according to claim 14 and characterized further in that said winding roller has a perforated periphery and means for applying a vacuum interiorly of said winding roller, and baffle means within the interior of said winding roller for directing the vacuum through said periphery in advance of the location of peripheral surface contact between said winding roller and said supporting roll for drawing the sheet into peripheral contact with said winding roller.

17. In an apparatus for winding a traveling sheet, an apparatus for removing a section of the sheet according to claim 16 and characterized further in that said winding roller has means for applying a forced fluid stream interiorly of said winding roller, said baffle means being arranged for directing the fluid stream through said periphery following the location of peripheral surface contact between said winding roller and said supporting roll for applying said sheet into peripheral contact with said supporting roll.

18. In an apparatus for winding a traveling sheet, an apparatus for removing a section of the sheet according to claim 9 and characterized further by means for transferring the supporting roll with the sheet wound thereon from a winding disposition to a discharge location upon completion of a winding operation.

19. In an apparatus for winding a traveling sheet, an apparatus for removing a section of the sheet according to claim 18 and characterized further by means for weighing each transferred roll.

* * * * *

UNITED STATES PATENT AND TRADEMARK OFFICE

CERTIFICATE OF CORRECTION

PATENT NO. : 4,930,711

DATED : June 5, 1990

INVENTOR(S) : Nicholas L. Morizzo

It is certified that error appears in the above-identified patent and that said Letters Patent is hereby corrected as shown below:

Column 1, Line 32, after "both" add -- cutting and removal operations executed simultaneously with the identification of the --.

Column 1, Line 64, after "with" add -- the --.

Column 2, Line 43, reads "fabic" but should read -- fabric --.

Column 2, Line 44, reads "frabic" but should read -- fabric --.

Column 2, Line 48, reads "fabic" but should read -- fabric --.

Column 2, Line 53, reads "fabic" but should read -- fabric --.

Column 4, Line 22, after "its" add -- perforated --.

Column 4, Line 67, reads "of" (first occurrence) but should read -- on --.

UNITED STATES PATENT AND TRADEMARK OFFICE

CERTIFICATE OF CORRECTION

PATENT NO. : 4,930,711

DATED : June 5, 1990

INVENTOR(S) : Nicholas L. Morizzo

It is certified that error appears in the above-identified patent and that said Letters Patent is hereby corrected as shown below:

Column 5, Line 1, after "inward" delete -- a --.

Column 8, Line 16, after "be" delete -- be --.

Column 9, Line 67, reads "the 10" but should read -- the sheet 10 --.

Signed and Sealed this

Twenty-ninth Day of September, 1992

*Attest:*

DOUGLAS B. COMER

*Attesting Officer*

*Acting Commissioner of Patents and Trademarks*